United States Patent [19]

Meyerhoefer et al.

[11] 4,359,615

[45] Nov. 16, 1982

[54] SWITCH AND MEANS TO PREVENT UNAUTHORIZED OPERATION THEREOF

[75] Inventors: Carl E. Meyerhoefer, Little Neck; Carl H. Meyerhoefer, Dix Hills, both of N.Y.

[73] Assignee: Black & Decker Inc., Newark, Del.

[21] Appl. No.: 292,440

[22] Filed: Aug. 14, 1981

[51] Int. Cl.[3] ..... H01H 9/20

[52] U.S. Cl. ..... 200/42 R; 200/42 T; 200/330; 200/334

[58] Field of Search ..... 200/42 R, 42 T, 44, 200/334, 50 R, 330, 331

[56] References Cited

U.S. PATENT DOCUMENTS

| | | | |
|---|---|---|---|
| 696,180 | 3/1902 | Marshall | 200/44 |
| 1,143,676 | 6/1915 | Williams | 200/42 R |
| 1,392,990 | 10/1921 | Vaughan | 83/817 |
| 1,726,964 | 9/1929 | Olley | 200/50 A |
| 2,180,501 | 11/1939 | Blood | 200/330 |
| 3,086,092 | 4/1963 | Poulton | 200/42 T |
| 3,288,954 | 11/1966 | Norden | 200/42 T |
| 3,602,662 | 8/1971 | Haller | 200/61.62 |
| 3,632,914 | 1/1972 | Osika | 200/42 T |
| 3,678,229 | 7/1972 | Osika | 200/42 T |
| 3,914,563 | 10/1975 | Prior | 200/42 T |
| 4,013,858 | 3/1977 | Grebner et al. | 200/42 T |
| 4,107,484 | 8/1978 | Petersen | 200/42 T |
| 4,168,416 | 9/1979 | Josemans | 200/42 T |
| 4,174,472 | 11/1979 | Josemans | 200/42 T |

FOREIGN PATENT DOCUMENTS

| | | | |
|---|---|---|---|
| 847851 | 9/1960 | United Kingdom | 200/42 T |

*Primary Examiner*—John W. Shepperd

*Attorney, Agent, or Firm*—Edward D. Murphy; Walter Ottensen; Harold Weinstein

[57] ABSTRACT

A switch actuator in the form of a bifurcated elongated member has a pair of legs pivoted relative to each other. In the "off" position of the switch, the legs may be pivoted relative to each other, and the actuator may be withdrawn from the switch. This precludes an unauthorized operation of the switch and the equipment controlled thereby. In the "on" position of the switch, an interlocking means precludes the relative pivotal movement of the legs, and the actuator may not be withdrawn from the switch. In the preferred embodiment, the legs of the actuator automatically engage an operating element of the switch, upon the insertion of the actuator into the switch. Thereafter, the actuator has a limited sliding movement to alternately move the switch into its "on" and "off" positions. Preferably, the switch is of the "pull on/push off" type; and the sliding movement of the actuator is in a plane which is substantially parallel to the linear movement of the switch operating element. Additionally, the actuator is provided with an enlarged outer portion to facilitate manipulation by the operator.

24 Claims, 24 Drawing Figures

SWITCH "OFF"

FIG. 10
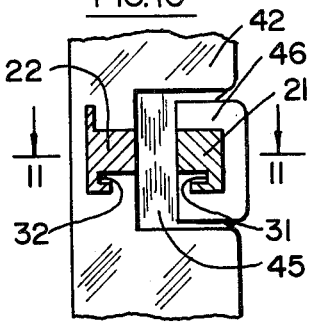
FIG. 16
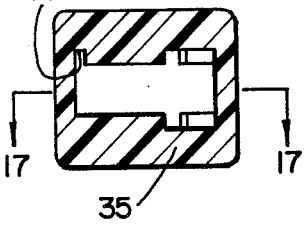
FIG. 17
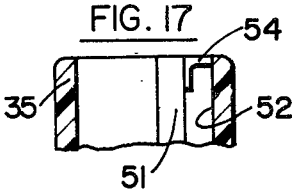
FIG. 18
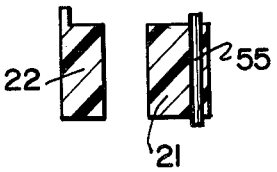
FIG. 11
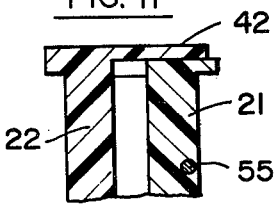
FIG. 8
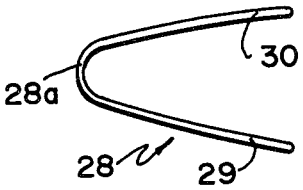
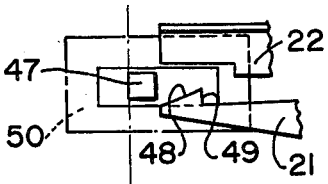
FIG. 12a
FIG. 9
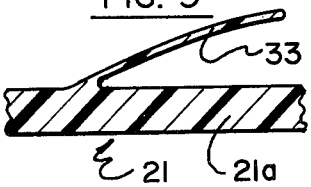
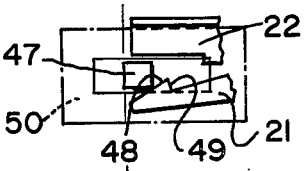
FIG. 12b
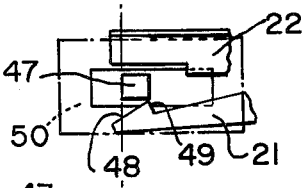
FIG. 12c
FIG. 7
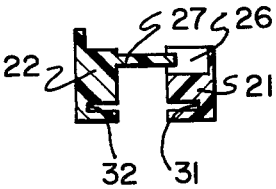
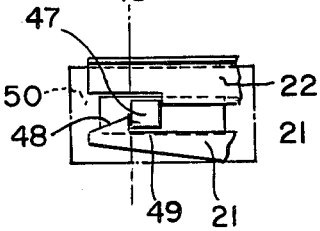
FIG. 12d

SHEET 2 OF 3

SWITCH "OFF"

SWITCH "ON"

SWITCH "OFF"

SWITCH AND MEANS TO PREVENT UNAUTHORIZED OPERATION THEREOF

BACKGROUND OF THE INVENTION

In various types of machinery and powered equipment, such as a table saw, it is desirable to preclude inadvertent or unauthorized operation of the switch and hence the equipment controlled thereby. In the prior art, of which I am aware, various means have been provided to preclude such unauthorized operation.

For example, the switch may be of the simple toggle type, and a u-shaped bracket may have its bight portion secured to the housing, such that the legs of the bracket extend on respective sides of the toggle. Each of the legs may have a hole formed therein, and with the toggle in its down or "off" position, a simple padlock may be inserted between the holes in the legs of the bracket and locked therein. Movement of the toggle into the "on" position will thereafter be precluded, until the padlock is removed.

Additionally, a key may be installed integrally on the machine, adjacent to a separately-mounted switch actuator, and removal of the key will preclude operation of the switch actuator from an "off" to an "on" position. These mechanisms are usually arranged, upon insertion of the key, to remove an internal barrier to movement of the switch actuator to its "on" position.

Additionally, the art has resorted to a variety of lock buttons or other locking members mounted within the switch actuator. For example, the lock button may comprise a bifurcated plug member having a pair of fixed prongs inserted into a receptacle in a rocker-type switch. The plug member may be removed to preclude pivotal movement of the rocker switch from its "off" position into its "on" position. Others in the art have used a similar pronged-type of removable lock button for a "pull on/push off" switch, wherein the actuator may be provided with an enlarged outer operating portion to facilitate its manipulation. Still others have resorted to a lock button in conjunction with a pistol-grip type of handle provided with a trigger switch; the lock button must be continually depressed to enable the switch to be actuated by the trigger. In this arrangement, the lock button may be removed to prevent an inadvertent or unauthorized use of the switch. Finally, the commercial art has disclosed an arrangement, wherein, the switch is completely inaccessible to the operator upon removal of the actuator.

The Peterson U.S. Pat. No. 4,107,484 is also illustrative of the development of the art. In this patent, a key-type of actuator is used with a rocker-type of switch. The key may be inserted into its keyway and then rotated for proper orientation with respect to the rocker switch. When so alined, the key may be pulled for moving the switch into its "on" position and pushed for moving the switch back into its "off" position. The key may be withdrawn from the switch only in the "off" position of the switch.

These prior art disclosures and structures are relatively complicated and sophisticated, hence expensive to manufacture and to assemble into a power-operated machine. Additionally, the stationary prongs of the plug-type keys may break off after repeated and extensive insertions of the keys into the switch actuator. Moreover, the switch may still be accessible, even after removal of the lock button, and any internal blockage within the switch may conceivably be over-ridden by the application of heavy manual pressure on the accessible switch.

SUMMARY OF THE INVENTION

Accordingly, it is an object of the present invention to provide a simple and economical actuator for a switch, one which is reliable and convenient to use, wherein the switch is completely inaccessible upon removal of the switch actuator.

It is another object of the present invention to provide a switch actuator in the form of a bifurcated elongated member slidably received within the switch, the member having a pair of legs pivotable relative to each other in the "off" position of the switch, thereby enabling the actuator to be completely removed from the switch.

It is yet another object of the present invention to provide a "pull on/push off" switch having a switch operating element in the form of a simple and economical slide button, wherein the actuator automatically engages the slide button upon insertion of the actuator into the switch, and wherein the actuator moves linearly in a plane parallel to the plane of motion of the slide button.

It is a further object of the present invention to provide a switch actuator having an enlarged outer operating portion formed with a longitudinal side edge having an arcuate cut-out, wherein the actuator has a pivotable portion accessible via the cut-out for facilitating removal of the actuator in the "off" position of the switch.

It is a still further object of the present invention to enclose the switch by means of a switch box mounted on the front of a panel for the housing of a table saw, wherein the switch box has boss means formed therein to facilitate the slidable insertion of the actuator through the switch box to engage the switch, and wherein interlocking means is provided between the switch box and the actuator to prevent withdrawal of the actuator in the "on" position of the switch, the interlocking action being avoided in the "off" position of the switch to facilitate subsequent withdrawal of the actuator.

In accordance with the teachings of the present invention, a switch has an operating element with respective "on" and "off" positions. A switch actuator is provided to prevent unauthorized operation of the switch. The actuator is slidably received within the switch, and upon insertion therein, automatically engages the switch operating element. Thereafter, the actuator has a limited slidable movement relative to the switch for moving the operating element of the switch between its respective "on" and "off" positions. In the preferred embodiment, the actuator comprises a bifurcated elongated member having a pair of legs pivotable relative to one another. The legs are biased to a first position, relative to one another, by suitable resilient means. In the "off" position of the switch, the legs may be pivoted against the resilient means to a second position relative to each other; and thereafter, the bifurcated elongated member may be withdrawn from the switch, thereby preventing an unauthorized operation of the switch. When the switch is in its "on" position, however, an interlock precludes the relative pivotal movement between the legs, thereby precluding the bifurcated elongated member from being withdrawn in the "on" position of the switch.

These and other objects of the present invention will become apparent from a reading of the following specification, taken in conjunction with the enclosed drawings.

BRIEF DESCRIPTION OF THE DRAWINGS

FIG. 7 is a section view, taken along the lines 7—7 of FIG. 4, showing the complementary arcuate projection and recess formed on the respective legs of the bifurcated member to facilitate pivotal movement therebetween, and further showing the torsion spring seated between the respective legs;

FIG. 8 is a plan view of the torsion spring in its relaxed position;

FIG. 9 is an alternate embodiment of the resilient means between the legs, comprising a leaf spring integrally molded on one of the legs;

FIG. 10 is a section view, taken along the lines 10—10 of FIG. 4, showing the operating portion of one leg accessible via the arcuate cut-out formed in the enlarged operating portion of the other leg, thereby facilitating a pivotal movement of the one leg with respect to the other leg;

FIG. 11 is a section view, taken along the lines 11—11 of FIG. 10.

FIGS. 12*a* through 12*d* are schematic sequence views, showing the manner in which the pivoted legs of the bifurcated switch actuator automatically engage the slide button of the switch upon the complete insertion of the actuator through the switch box to engage the switch.

FIG. 16 is a section view, taken along the lines 16—16 of FIG. 3, drawn to an enlarged scale, and showing the slots (in the outer boss of the switch box) forming part of the interlocking means;

FIG. 17 is a section view, taken along the lines 17—17 of FIG. 16, showing one set of slots in plan outline;

FIG. 18 is a section view taken across the lines 18—18 of FIG. 3, drawn to an enlarged scale, and showing a pin cooperating with the slots to form the interlocking means.

DETAILED DESCRIPTION

Figure 1:
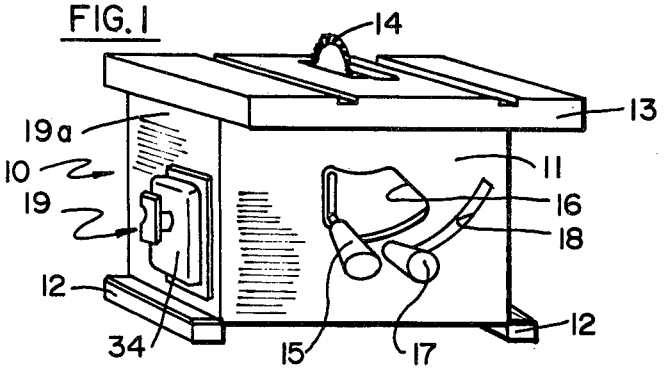
FIG. 1 is an isometric view of a table saw with which a preferred embodiment of the present invention may find particular utility.

With reference to FIG. 1, there is illustrated a table saw 10 with which the teachings of the present invention may find particular utility. It will be understood by those skilled in the art, however, that the teachings of the present invention are not necessarily confined to the saw, but are equally applicable to a wide variety of switches and apparatus controlled thereby. With this in mind, the saw 10, which is intended for use by contractors and advanced home craftsmen, comprises a housing 11, supporting feet 12 for mounting the housing on a bench or suitable platform, a table top 13, a blade 14 projecting above the table, an elevation control lever 15 movable in an opening 16, the lever adjusting the extent to which the blade projects above the table (and in an alternate mode of operation, for raising the blade up out of the table to make a cut in a workpiece held securely on the table), a bevel control lever 17 movable in a quadrant opening 18 for tilting the saw blade relative to the table (from zero to forty-five degrees) to make a bevel cut in a workpiece, and a switch assembly 19 mounted on a side panel 19*a* of the housing.

Figure 6:
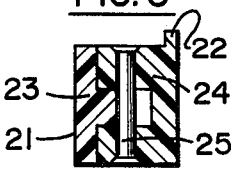
FIG. 6 is a section view, taken along the lines 6—6 of FIG. 4, showing the pivot means between the legs of the bifurcated switch actuator.

With reference to FIGS. 2 through 6, the switch is actuated by a switch actuator 20 which comprises a bifurcated elongated member having a pair of legs 21 and 22. These legs have respective first and second portions, designated 21*a*, 21*b* and 22*a*, 22*b*, respectively. A laterally-projecting boss is formed on each leg, between its respective first and second portions. These bosses, designated 23 and 24, respectively, are formed complementary to each other and, as shown in FIG. 6, nest with respect to each other. A pin 25 is received between the bosses, thereby pivoting the legs with respect to each other. The respective first portion 21*a* of leg 21 has a blind arcuate recess 26 formed therein, as shown more clearly in FIG. 4, and the respective first portion 22*a* of leg 22 has a complementary arcuate projection 27 formed thereon to be received in the arcuate recess. The projection and its recess are formed about a radius from the pivot axis provided by the pin, thereby facilitating the relative pivotal movement between the legs. A torsion spring 28, shown in plan view in FIG. 8, has its bight portion 28*a* seated adjacent to the pivot axis between the legs, as shown more cleraly in FIG. 4, and further has respective leg portions 29 and 30 seated in respective blind longitudinal slots 31 and 32 formed in the respective first portions 21*a*, 22*a* (of the respective legs 21, 22 of the bifurcated switch actuator) thereby providing a resilient means between the respective first portions of the legs. Alternatively, as shown in FIG. 9, the resilient means may comprise an integrally-molded leaf spring 33 formed on one of the legs, bearing against the other leg, and compressed thereby. In any event, the resilient means constantly urges the respective first portions 21*a*, 22*a* apart, and conversely, constantly urges the respective second portions 21*b*, 22*b* together.

Figure 5:
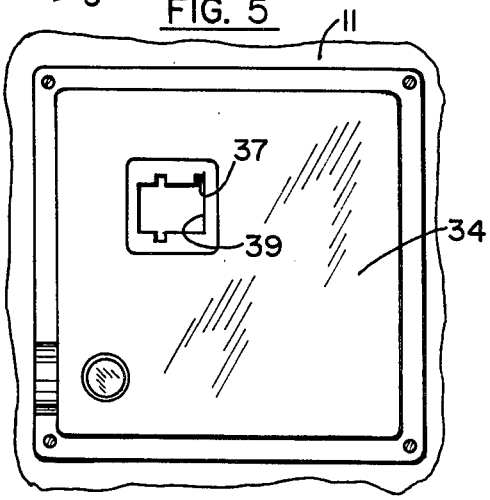
FIG. 5 is a front elevation o the switch box with the switch actuator removed.
Figure 4:
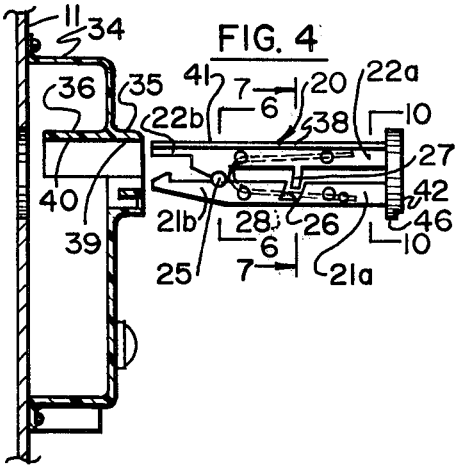
FIG. 4 is a stepped section view, taken along the lines 4—4 of FIG. 3, and showing the switch actuator in plan view, the actuator being formed as a bifurcated elongated member with a pair of legs having a relative pivotal movement therebetween.

With reference again to FIGS. 2 through 4, the switch assembly further includes a switch box 34 secured to the side panel 19*a* of the saw. This switch box is preferably rectangular in plan outline and is raised away from the panel. An outer boss 35 is formed on the front of the switch box, and an inner boss 36 is formed within the switch box, the inner boss being formed as a partial continuation of the outer boss as shown more clearly in FIG. 4. The outer boss has a longitudinal slot 37 formed therein, as shown in FIG. 5, to receive a complementary longitudinal ridge 38 formed on the leg 22. As a result, when the switch actuator is inserted into the switch box, the leg 22 is restrained against pivotal movement. Additionally, the outer boss has a side wall 39 adjacent to its slot 37, and the inner boss has a side wall 40 formed coplanar with the side wall 39 of the outer boss. The leg 22 has a flat side surface 41 which bears against the coplanar walls 39, 40 of the respective bosses. Thus, the leg 22 is restrained against pivotal movement, while the leg 21 is free to pivot relative to leg 22.

Figure 2:
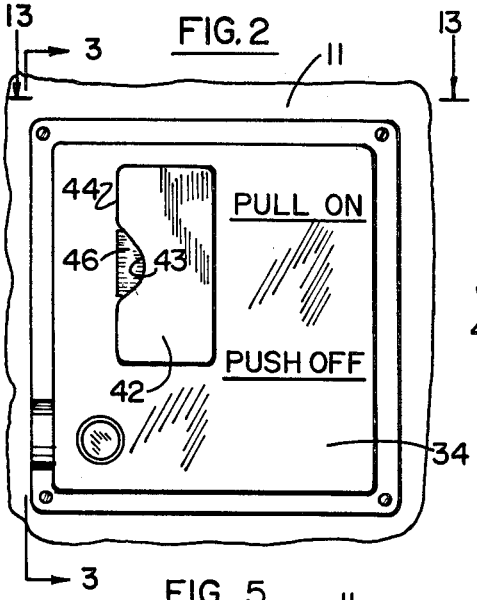
FIG. 2 is a front elevation of the side panel of the table saw, showing the switch box and the switch actuator mounted thereon.
Figure 3:
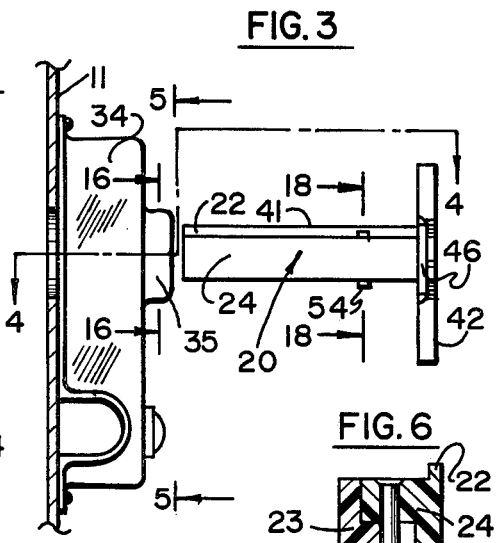
FIG. 3 is a view, taken along the lines 3—3 of FIG. 2, but with the switch actuator removed from the switch box and shown in exploded elevation.

With reference again to FIGS. 2 and 3, and with further reference to FIGS. 10 and 11, the leg 22 has an outer operating portion 42 formed integrally therewith. This operating portion 42 is preferably formed as a rectangle in plan outline, as shown in FIG. 2. The portion 52 is enlarged and extends laterally of the boss and parallel to the switch box for convenient use by the operator. An arcuate cut-out 43 is formed along a longitudinal side edge 44 of the enlarged operating portion 42, and a blind transverse recess 45 is formed in the underside of the enlarged operating portion 42 adjacent to the arcuate cut-out 43. The one leg 21, which pivots, also has an integrally-formed operating portion 46 (of smaller dimensions than the enlarged operating portion 42 of the other leg 22). This operating portion 46 is seated partially in the blind transverse recess 45 and is accessible via the arcuate cut-out 43 in the enlarged operating portion 42.

In operation, the user may grasp the enlarged operating portion 42 with his fingers, and with his thumb depress the operating portion 46 of leg 21 further into the blind transverse recess 45, thereby pivoting leg 21 relative to the non-pivotal (fixed) leg 22 to facilitate the subsequent withdrawal of the switch actuator 20 from the switch assembly.

With reference to FIGS. 12*a* through 12*d*, it will be appreciated that when the switch actuator 20 is slidably received into the switch assembly, and fully seated therein, the switch operating element comprising the slide button 47 is automatically engaged by the switch actuator. Thus, FIG. 12*a* shows the initial engagement between the switch button 47 and the respective inner ends of the legs 21, 22. As the switch actuator is moved further into the switch assembly, the switch button 47 engages the chamfered edge 48 of the pivotal leg 21, thereby pivoting the leg 21 against the force of the torsion spring. When the actuator is moved still further, the leg 21 has pivoted its maximum amount, as shown in FIG. 12*c*, and thereafter the chamfered edge 48 rides up over the switch button 47, the leg 21 pivots back in an opposite direction under spring action, and the switch button is thereby received in a transverse notch 49 formed at the end of chamfered edge 47. The switch button 47 is thereby automatically engaged by the switch actuator 20, as the actuator is slidably received in the switch assembly, and a "snap action" is achieved by means of the torsion spring.

Figure 14:
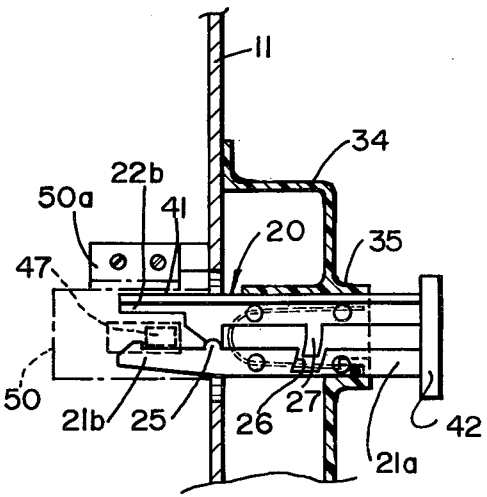
FIG. 14 corresponds to FIG. 13, but shows the actuator pulled out (away from the switch box) to move the switch from its "off" position into its "on" position, the view showing the interlocking means between the actuator and the switch box to prevent pivotal movement between the legs, thereby preventing withdrawal of the actuator in the "on" position of the switch.
Figure 13:
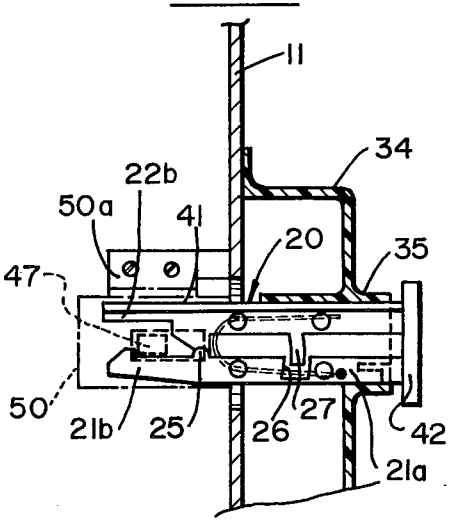
FIG. 13 is a top plan view, taken along the lines 13—13 of FIG. 2, with parts broken away and sectioned, and showing the switch actuator fully inserted into the switch, the switch being in its "off" position.

With reference to FIG. 13, the switch actuator 20 is fully seated within the switch assembly 19 and has engaged the switch button 47. The actuator is shown in its innermost (retracted) position within the switch assembly and with its operating portion 44 adjacent to the outer boss 35 on the switch box 34, which is the "off" position of the switch. The actuator has a limited linear movement in a plane parallel to the plane of movement of the switch button 47. As shown in FIG. 14, the actuator has been pulled out (and away from the switch box) to move the switch from its "off" position into its "on" position, the switch being of the "pull on/push off" type. Preferably, the switch button is part of a simple (and inexpensive) slide switch, designated as at 50, and the switch is mounted within the housing by means of a bracket 50*a*.

With reference to FIGS. 14 through 18, the outer boss 35 of the switch box has a pair of slots 51 and 52 formed therein. These slots are separated by a side ridge 53. Slot 51 is open, while slot 52 is closed by an end ridge 54. These slots and ridges cooperate with a pin 55 carried by the pivotal leg 21 and extending therefrom. Preferably, the pin extends from both the top and bottom of leg 21, and similar slots are formed on both the top and bottom of the outer boss 35.

Figure 15:
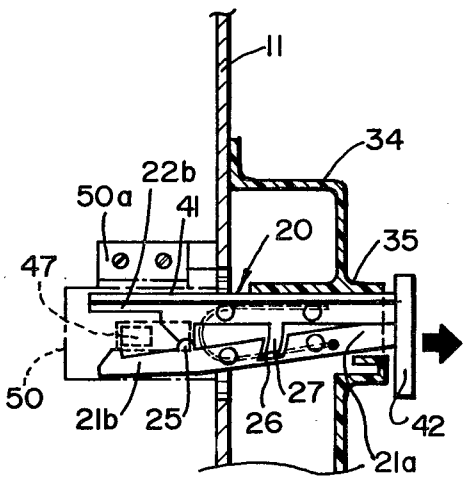
FIG. 15 corresponds to FIG. 13, but shows the switch in its "off" position with the actuator pushed back towards the switch box, and further showing how the interlock is disabled to facilitate relative pivotal movement between the legs of the actuator, the arrow indicating the direction in which the switch actuator may be removed.
Figure 19C:
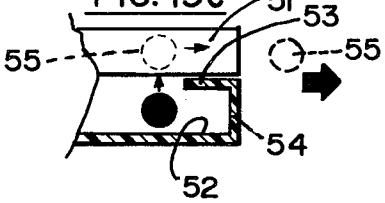
FIGS. 19*a* through 19*c* are schematic sequence views, corresponding to FIGS. 13-15, respectively, and showing the function of the interlocking means between the switch actuator and the switch box.
Figure 19B:
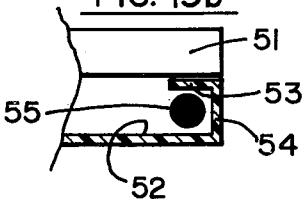
Figure 19A:
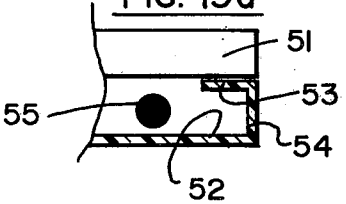

With reference again to FIGS. 14 through 18, and with further reference to FIGS. 19*a* through 19*c*, the pin and slots cooperate to form an interlocking means to preclude relative pivotal movement between the legs 21, 22, and hence preclude withdrawal of the bifurcated switch actuator 20 in the "on" position of the switch. Thus, as shown in FIGS. 14 and 19*a*, the switch is in its "on" position, and the pin 55 is received all the way down in the closed slot 52 adjacent to the end ridge 54. In this position, the leg 21 carrying the pin 55 cannot be pivoted, and hence the actuator cannot be removed from the switch. As shown in FIGS. 15 and 19*b*, however, the switch is in its "off" position, and pin 55 is still in the slot 52 but beyond the side ridge 53. In this position, the leg 21 may be pivoted, moving the pin 55 to the open slot 51 as indicated in FIG. 19*c*. Thereafter, the actuator may be removed from the switch, as indicated by the arrow, to the position shown in FIG. 3. The actuator 20 may be retained and safeguarded by the user to prevent an unauthorized or inadvertent operation of the switch and hence the table saw 10.

To re-insert the actuator within the switch box, the legs are again pivoted relative to each other, so that the pin 55 is received within the open slot 51, and with the actuator properly oriented for cooperation between the longitudinal ridge 38 and its cooperating slot 37.

Obviously, many modifications may be made without departing from the basic spirit of the present invention. For example, both legs could be adapted to pivot if desired. Accordingly, it will be appreciated by those skilled in the art, that within the scope of the appended claims, the invention may be practiced other than has been specifically described herein.

We claim:

1. In combination with a switch having an operating element with respect "on" and "off" positions, switch actuating means to prevent unauthorized operation of the switch, said means comprising a bifurcated elongated member slidably received within the switch, said bifurcated elongated member having respective legs, means for pivoting the legs relative to each other, the legs having respective first and second portions on opposite sides of the pivoting means, resilient means urging the respective first portions of the legs apart and the respective second portions of the legs together, means allowing the bifurcated elongated member to be slidably inserted into the switch, means operative upon the insertion of the bifurcated elongated member into the switch for engagement of the respective second portion of at least one of the legs with the operating element of the switch, the bifurcated elongated member thereafter having a limited sliding movement relative to the switch for moving the operating element between the respective "on" and "off" positions of the switch, means for preventing withdrawal of the bifurcated elongated member from the switch in the "on" position of the switch, means operative in the "off" position of the switch for allowing the respective first portion of at least one of the legs of the bifurcated elongated member to be pivoted towards the respective first portion of the other leg of the member, and against the force of the resilient means, and concurrently pivoting the respective second portion of said one leg away from the respective second portion of said other leg, thereby disengaging the bifurcated elongated member from the switch operating element, and whereby the bifurcated elongated member thereafter may be slidably withdrawn from the switch, thereby precluding an unauthorized operation of the switch.

2. The combination of claim 1, wherein each of the legs is molded from a suitable plastic material.

3. The combination of claim 1, wherein the pivoting means comprises a boss formed on each of the legs between the respective first and second portions thereof, each boss extending laterally away from its leg towards the other leg, the bosses being formed complementary to each other and having a nesting engagement with each other, and a pin extending between the bosses.

4. The combination of claim 1, wherein the resilient means comprises a torsion spring lodged between the respective first portions of the legs.

5. The combination of claim 4, wherein the torsion spring has a bight portion and respective leg portions extending therefrom, the bight portion being disposed adjacent to the pivoting means for the legs of the bifurcated elongated member, and the respective first portions of the legs of the bifurcated elongated member each having a blind longitudinal slot formed therein for receiving a respective leg portion of the spring.

6. The combination of claim 1, wherein the resilient means comprises a leaf spring formed integrally on a respective first portion of one of the legs of the bifurcated elongated member, the end of the leaf spring bearing against the respective first portion of the other leg of the bifurcated elongated member.

7. The combination of claim 1, wherein the respective first portion of the said one leg has an arcuate transverse projection, and wherein the respective first portion of the said other leg has a complementary arcuate recess, the arcuate projection and recess being formed along a radius from the pivot means between said legs, thereby facilitating the relative pivotal movement between the legs.

8. The combination of claim 1, wherein the switch is mounted in the housing of a power-operated device, and wherein a switch box is mounted externally of the housing to at least partially enclose the switch.

9. The combination of claim 8, wherein the switch box has a front wall provided with an outer boss projecting therefrom and an inner boss projecting therein, the inner boss being formed as a partial continuation of the outer boss, and the outer boss having a longitudinal slot formed therein, and wherein a complementary longitudinal ridge is formed on said other leg of the bifurcated elongated member and is received in the longitudinal slot, thereby facilitating the slidable insertion of the bifurcated elongated member through the switch box to engage the switch.

10. The combination of claim 9, wherein the outer boss has a side wall adjacent to the longitudinal slot formed therein, and the inner boss has a side wall formed as a continuation of the side wall of the outer boss, and wherein said other leg of the elongated bifurcated member has a flat surface adjacent to its longitudinal ridge, the flat surface bearing against the respective walls of the bosses as the elongated bifurcated member is slidably inserted into the switch box.

11. The combination of claim 10, wherein the said other leg is held against pivotal movement by engagement of its longitudinal ridge within the complementary longitudinal slot, and wherein only the said one leg member is pivotably movable to facilitate insertion and withdrawal of the bifurcated elongated member through the switch box to engage the switch.

12. The combination of claim 9, wherein only said one leg of the bifurcated elongated member is pivotably moveable, the said other leg being restrained against pivotal movement, and wherein the said other leg has an integrally-formed outer operating portion engageable by the operator for moving the switch from its "off" position into its "on" position, and vice-versa.

13. The combination of claim 12, wherein the switch is of the "push-off, pull-on" type and requires a deliberate movement to pull the operating portion away from the switch box to turn the switch "on", and wherein only a simple push on the operating portion is required to turn the switch "off".

14. The combination of claim 13, wherein the said operating portion has a substantially rectangular plan outline, and wherein the said operating portion confronts the respective edges of the outer boss of the switch box and is normally disposed adjacent thereto in the "off" position of the switch, the dimensions of the said operating portion being greater than the corresponding dimensions of the outer boss, whereby the outer operating portion extends laterally beyond the boss and substantially parallel to the outer surface of the switch box.

15. The combination of claim 14, wherein the said operating portion of the said other leg has a longitudinal side edge with a blind transverse recess formed therein, the recess terminating in an arcuate cut-out adjacent to the longitudinal side edge, and wherein the said one leg has a respective outer operating portion disposed in a plane substantially at right angles to the sliding movement of the bifurcated elongated member, the respective operating portion of the said one leg being nested partially in the blind transverse recess of the said operating portion of the said other leg, and being accessible via the arcuate cutout therein, whereby the respective operating portion of the said one leg may be engaged by the operator's thumb to move the respective operating portion laterally and further into the blind transverse recess in the said operating portion of the said other leg, thereby pivoting the said one leg towards the said other leg, against the force of the resilient means, to facilitate withdrawal of the bifurcated elongated member in the "off" position of the switch.

16. The combination of claim 1, wherein only one of the legs of the bifurcated elongated member has a pivotal movement, the other leg being restrained against pivotal movement, and wherein the means operative upon the insertion of the bifurcated elongated member into the switch for engagement of at least the respective second portion of said one leg with the operating element of the switch comprises a transverse chamfer formed on the end of the respective second portion of the said one leg, the respective second portion of the said other leg having an end confronting the transverse chamfer, the transverse chamfer terminating in a recessed transverse notch formed in the said one leg, whereby, as the bifurcated elongated member is inserted into the switch, the switch operating element is received between the transverse chamfer on the said one leg and the confronting end of the said other leg, thereby pivoting the said one leg, and whereby, as the bifurcated elongated member is further inserted into the switch, the transverse chamfer rides over the switch operating element, and the switch operating element is thereafter received within the recessed transverse notch as the said one leg pivots in an opposite direction, the cooperation of the switch operating element with the transverse chamfer and recessed transverse notch, together with the resilient means between the legs, thereby enabling the switch operating element to be automatically engaged with a "snap" action as the bifurcated elongated member is inserted fully within the switch.

17. The combination of claim 1, wherein only one of the legs of the bifurcated elongated member has a pivotal movement, the other leg being restrained against pivotal movement, and wherein the means for preventing the withdrawal of the bifurcated elongated member in the "on" position of the switch comprises, a switch housing having a pair of parallel longitudinal slots formed therein, one of the slots being open and the other closed, a transverse pin carried by the respective first portion of the said one leg of the bifurcated elongated member, the pin being substantially parallel to the pivot axis, and the pin having at least one portion extending beyond the said one leg, whereby in the "off" position of the switch, the said one leg may be pivoted to enable the extending portion of the pin to be received in the open slot, whereby the bifurcated elongated member may thereafter be withdrawn from the switch, and whereby in the "on" position of the switch, the extending portion of the pin is received in the closed slot to preclude pivotal movement of the said one leg, thereby preventing withdrawal of the bifurcated elongated member from the switch in the "on" position of the switch.

18. In combination with a switch having an operating element with respective "on" and "off" positions, switch actuating means to prevent unauthorized operation of the switch, said means comprising a bifurcated elongated member, means allowing the member to be slidably inserted into the switch, means operative upon the full insertion of the member within the switch for coupling engagement between the member and the switch operating element, the member thereafter having a limited slidable movement relative to the switch for moving the operating element between the respective "on" and "off" positions of the switch, the member having a pair of legs pivoted relative to each other, resilient means biasing the pivoted legs to a first position relative to each other, means operative in the "off" position of the switch for allowing the legs to be pivoted against the resilient means and into a second position relative to each other for thereafter withdrawing the bifurcated elongated member out of the switch, thereby precluding an unauthorized operation of the switch, and means for preventing the relative pivotal movement between the legs to preclude withdrawal of the bifurcated elongated member in the "on" position of the switch.

19. In combination with a switch having an operating element with respective "on" and "off" positions, the operating element comprising a slide button moving linearly in a given plane, switch actuating means to prevent unauthorized operation of the switch, said means comprising an elongated non-rotatable switch actuator, means allowing the switch actuator to be slidably inserted into the switch along a plane substantially parallel to the plane of movement of the slide button, resiliently-biased means automatically operative upon the slidable insertion of the elongated switch actuator for effecting a "snap action" engagement between the actuator and the slide button, the actuator thereafter having a limited sliding movement in a plane substantially parallel to the plane of movement of the slide button for moving the switch between its respective "on" and "off" positions, means for preventing withdrawal of the actuator from the switch in the "on" position of the switch, and means operative in the "off" position of the switch for allowing the actuator to be moved against the force of the resiliently-biased means and sufficiently to clear the slide button, whereby the actuator thereafter may be withdrawn from the switch, thereby preventing an unauthorized operation of the switch.

20. In combination with a switch having a sliding operating element moving linearly in a plane between respective "on" and "off" positions, a non-rotatable actuator slidably inserted into the switch along a plane which is parallel to the plane of linear movement of the switch operating element, resiliently-biased means automatically operative upon the slidable insertion of the switch actuator within the switch for effecting a "snap action" engagement between the actuator and the switch operating element, the switch actuator being pulled out to move the switch into its "on" position and pushed in to move the switch into its "off" position, means operative in the "off" position of the switch for allowing the actuator to be moved against the force of the resiliently-biased means and sufficiently to clear the switch operating element, whereby the actuator may be withdrawn entirely from the switch, whereby the switch operating element is thereafter completely inaccessible, and whereby inadvertent or unauthorized operating of the switch is thereby precluded, and means for preventing withdrawal of the actuator in the "on" position of the switch.

21. In combination with a switch having an operating element with respective "on" and "off" positions, a non-rotatable actuator slidably inserted into the switch, resiliently-biased means automatically operative upon the slidable insertion of the actuator into the switch for effecting a "snap action" engagement between the actuator and the switch operating element, the actuator thereafter having a limited linear movement with respect to the switch for moving the switch operating element between its respective "on" and "off" positions, the actuator having an outer operating portion enlarged laterally with respect to the actuator, the enlarged operating portion being pulled out to move the switch into its "on" position and pushed in to move the switch into its "off" position, means operative in the "off" position of the switch for allowing the actuator to be moved against the force of the resiliently-biased means and sufficiently to clear the switch operating element, whereby the actuator thereafter may be withdrawn entirely from the switch, thereby precluding an unauthorized operation of the switch, and means for preventing withdrawal of the actuator in the "on" position of the switch.

22. In combination with a switch having respective "on" and "off" positions and further having a switch housing, a switch actuator received in the switch housing for moving the switch between its respective "on" and "off" positions, the switch being of the push-pull type, the actuator having an outer operating portion, said portion having a substantially rectangular plan outline and being enlarged laterally with respect to the actuator, said portion being pulled out to turn the switch "on" and pushed in to turn the switch "off", interlocking means between the actuator and the switch housing for preventing withdrawal of the actuator from the switch housing in the "on" position of the switch, and means allowing the actuator to be withdrawn from the switch housing in the "off" position of the switch, thereby precluding unauthorized operation of the switch, said last-named means including an accessible element carried by the actuator adjacent to the operating portion of the actuator, said element being movable in the "off" position of the switch and relative to the operating portion of the actuator to move the actuator sufficiently to clear the interlocking means between the actuator and the switch housing, whereby the actuator may be removed from the switch in the "off" position of the switch.

23. In combination with a switch having respective "on" and "off" positions and further having a switch housing, a switch actuator received in the switch housing for moving the switch between its respective "on" and "off" positions, the switch being of the push-pull type, the actuator having an outer operating portion enlarged with respect to the actuator, the operating portion being pulled out to turn the switch "on" and pushed in to turn the switch "off", interlocking means between the actuator and the switch housing for preventing removal of the actuator from the switch housing in the "on" position of the switch, and means for facilitating removal of the actuator from the switch housing in the "off" position of the switch, thereby precluding unauthorized operation of the switch, said last-named means including an element carried by the actuator and disposed adjacent to the operating portion of the actuator, said element being engageable by the operator's thumb for movement laterally with respect to the operating portion of the actuator, thereby moving the switch actuator sufficiently to clear the interlocking means between the actuator and the switch housing, and thereby allowing the actuator to be withdrawn from the switch in the "off" position of the switch.

24. In a table saw having a housing provided with a panel, and further having a switch within the housing, the switch being provided with an operating element for moving the switch between its "on" and "off" positions, the operating element being movable linearly in a given plane, the combination of a switch box mounted on the front of the panel and projecting therefrom, a switch actuator, means cooperating between the actuator and the switch box for facilitating the slidable insertion of the actuator through the switch box and within the housing, resiliently-biased means operative upon the slidable insertion of the actuator for automatically effecting a direct "snap action" engagement between the actuator and the switch operating element, the actuator thereafter having a limited slidable movement within the switch box and in a plane substantially parallel to the plane of movement of the switch operating element for moving the operating element between its "on" and "off" positions, interlocking means between the actuator and the switch box to prevent the actuator from being withdrawn from the switch box in the "on" position of the switch, and means operative in the "off" position of the switch for moving the switch actuator against the force of the resiliently-biased means and sufficiently to clear the interlocking means between the actuator and the switch box, whereby the actuator thereafter may be disengaged from the switch operating element, and whereby the actuator may be withdrawn from the switch in the "off" position of the switch.

* * * * *